US006155889A

United States Patent [19]

Scarla et al.

[11] Patent Number: 6,155,889

[45] Date of Patent: Dec. 5, 2000

[54] BATTERY TERMINAL CONNECTOR

[75] Inventors: Robert Scarla, Scottsdale; John Kohutich, Phoenix, both of Ariz.

[73] Assignee: Lightning Audio Corporation

[21] Appl. No.: 09/226,382

[22] Filed: Jan. 6, 1999

[51] Int. Cl.[7] ..... H01R 4/50

[52] U.S. Cl. ..... 439/774; 439/760

[58] Field of Search ..... 439/774, 770, 439/760, 761, 762, 765, 766, 522, 754

[56] References Cited

U.S. PATENT DOCUMENTS

| | | | |
|---|---|---|---|
| 1,633,176 | 6/1927 | Goeller . | |
| 1,687,262 | 10/1928 | Vaughn . | |
| 1,794,812 | 3/1931 | Ward . | |
| 2,114,225 | 4/1938 | Johnson et al. . | |
| 2,541,617 | 2/1951 | Scott . | |
| 2,737,638 | 3/1956 | Lade | 439/774 |
| 3,568,139 | 3/1971 | Delzer . | |
| 4,455,059 | 6/1984 | Theiler . | |
| 4,623,212 | 11/1986 | Hogan . | |
| 4,936,799 | 6/1990 | Woodall . | |
| 5,302,142 | 4/1994 | Tabata . | |
| 5,302,143 | 4/1994 | Inoue et al. . | |
| 5,407,369 | 4/1995 | Oster | 439/762 |
| 5,454,741 | 10/1995 | Okada . | |
| 5,584,730 | 12/1996 | Tabata . | |
| 5,595,511 | 1/1997 | Okada . | |

*Primary Examiner*—Lincoln Donovan
*Assistant Examiner*—Hae Moon Hyeon
*Attorney, Agent, or Firm*—Richard E. Oney

[57] ABSTRACT

A battery terminal connector for connecting a battery cable to a battery terminal post includes a clamp body, a compression ring and a compression plate. The clamp body has a tapered hole for loosely receiving the battery terminal post. The conductive compression ring has a tapered inner peripheral wall and a tapered outer peripheral wall and is sized to fit into the tapered hole of the clamp body and over the battery terminal post. The taper of the inner and outer peripheral walls of the ring are opposed to each other. A compression plate is mounted to the clamp body and includes a flange for pressing the compression ring into the tapered hole to compress the ring and achieve tight electrical contact among the terminal post, the compression ring and the clamp body. The clamp body, the compression ring and the compression plate are made of a material having a hardness of at least about 60 on the Rockwell B scale.

12 Claims, 2 Drawing Sheets

FIG. 4
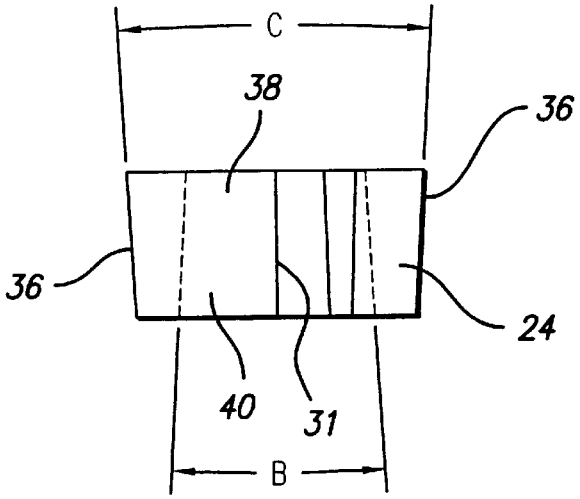
FIG. 5B
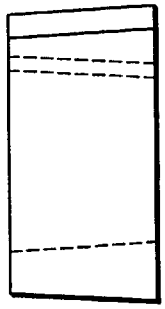
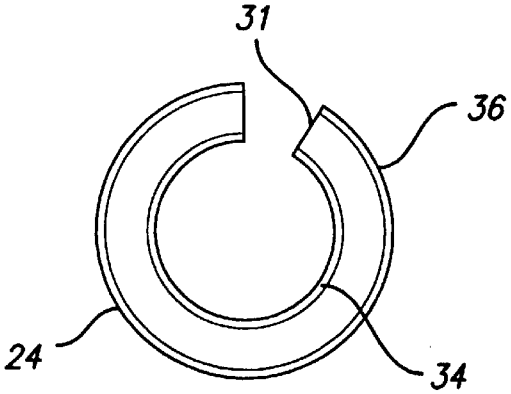
FIG. 5A
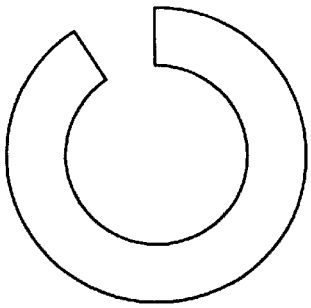
FIG. 5C
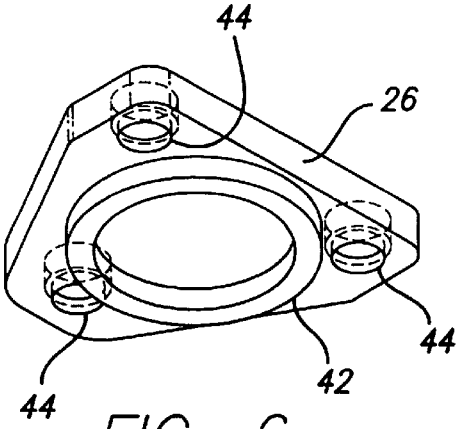
FIG. 6
FIG. 7
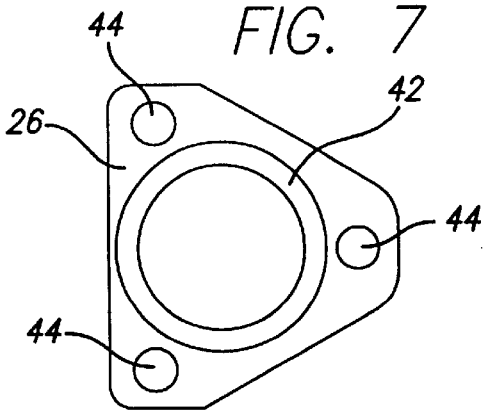

BATTERY TERMINAL CONNECTOR

BACKGROUND

This invention relates generally to electrical terminal connectors, and more specifically to an improved battery terminal connector that is easy to connect and remove, that provides a tight electrical connection and that has durable and reusable parts.

Conventional battery terminal connectors for batteries used in vehicles utilize an annular terminal fitting that fits over a battery terminal projecting from the battery. This fitting is clamped using a bolt and nut oriented generally perpendicularly to the terminal post, which is tightened by a relatively large wrench or other tightening tool. With the engine compartments of vehicles being crowded with many components installed in a tight space, it can be difficult to tighten and remove such connectors without the engine components or compartment wall interfering with the tightening tool. Another shortcoming of prior battery terminal connectors is that they require a prying action to remove the connector from the battery terminal post, which can put unwanted strain on the terminal post and connector. Yet another shortcoming of these connectors is that they are susceptible to galling and other damage because of softness of the metal used for the connector, which is used so the connector will adhere to the battery post.

There is a need, therefore for a battery terminal connector for providing a tight electrical connection and that is easy to connect and remove from a battery terminal post. Accordingly, it is an object of this invention to provide a novel and improved battery terminal connector that can be easily and tightly connected to a battery post using a relatively small tool and that provides an excellent electrical connection that resists loosening by jarring and vibration.

Another object of the invention is to provide a battery terminal connector that is neat appearing and durable.

A further object of the invention is to provide a battery terminal connector method that can accommodate different sized battery cables.

Yet another object of the invention is to provide a battery terminal connector that includes reusable parts.

Additional objects and advantages of the invention will be set forth in the description which follows, and in part will be apparent from the description, or may be learned by practice of the invention. The objects and advantages of the invention may be realized and obtained by means of the instrumentalities and combinations pointed out in the appended claims.

SUMMARY

To achieve the foregoing objects, and in accordance with the purposes of the invention as embodied and broadly described in this document, a battery terminal connector is provided for connecting a battery cable to a battery terminal post. The battery terminal connector includes a clamp body having battery cable connecting means for connecting the battery cable to the clamp body and a tapered hole for loosely receiving the battery terminal post. The tapered hole has an electrically conductive interior surface electrically coupled to the battery cable connecting means. A generally elongated, electrically conductive compression ring has a tapered inner peripheral wall and a tapered outer peripheral wall. The compression ring is sized to fit into the tapered hole of the clamp body and over the battery terminal post, and the taper of the inner and outer peripheral walls of the ring being opposed to each other. A compression plate is adapted to be mounted to the clamp body for pressing the compression ring into the tapered hole when the compression flange is mounted to the clamp body. Mounting means are included for mounting the compression plate to the clamp body.

In the preferred embodiment of the invention, the clamp body includes at least one threaded hole generally parallel to the tapered hole for receiving a threaded fastener. Also, the compression plate includes at least one mounting hole for receiving the threaded fastener, and the at least one mounting hole is aligned with the at least one clamp body threaded hole when the compression plate is mounted to the clamp body.

Preferably, although not necessarily, for neatness of appearance, durability and reusability, the clamp body, the compression ring and the compression plate are made of a material having a hardness of at least about 60 on the Rockwell B scale.

In accordance with the invention, a method for connecting a battery cable to a battery terminal post includes the step of providing a clamp body having battery cable connecting means for connecting the battery cable to the clamp body and a tapered hole for loosely receiving the battery post and having an electrically conductive interior surface electrically coupled to the battery cable connecting means. The method also includes the step of providing a generally elongated, electrically conductive compression ring having a tapered inner peripheral wall and a tapered outer peripheral wall, the compression ring being sized to fit into the tapered hole of the clamp body and over the battery terminal post, and the taper of the inner and outer peripheral walls of the ring being opposed to each other. The method also includes the steps of placing the clamp body over the battery terminal post, placing the compression ring over the battery terminal post, providing a compression plate adapted to be mounted to the clamp body for pressing the compression ring into the tapered hole when the compression plate is mounted to the clamp body, and mounting the compression plate to the clamp body.

BRIEF DESCRIPTION OF THE DRAWINGS

The accompanying drawings, which are incorporated in and constitute a part of the specification, illustrate the presently preferred embodiment and method of the invention, and together with the general description given above and the detailed description of the preferred embodiment and method given below, serve to explain the principles of the invention.

FIG. 4 is a side view of the compression ring shown in FIG. 1.

FIG. 5 is a bottom plan view of the compression ring of FIG. 4.

FIG. 6 is a bottom perspective view of the compression plate shown in FIG. 1, showing the circular flange disposed on the compression plate.

FIG. 7 is a bottom plan view of the compression plate shown in FIG. 1.

DESCRIPTION

Figure 1:
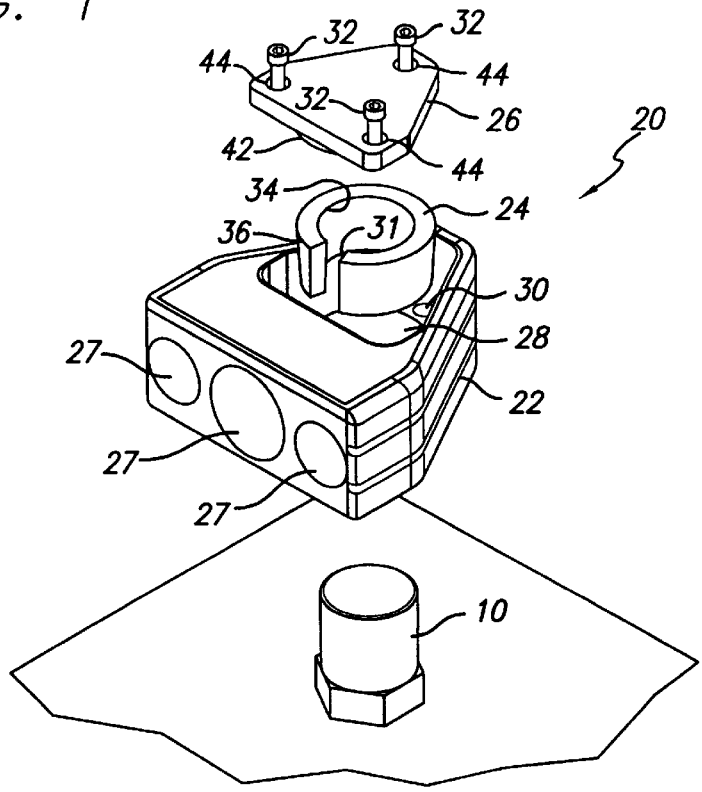
FIG. 1 is an exploded top perspective assembly view of a terminal connector in accordance with the invention, showing the clamp body, the compression ring, the compression plate and a typical automobile battery terminal post.

Reference will now be made in detail to the presently preferred embodiments and methods of the invention as illustrated in the accompanying drawings, in which like reference characters designate like or corresponding parts throughout the drawings.

Figure 2:
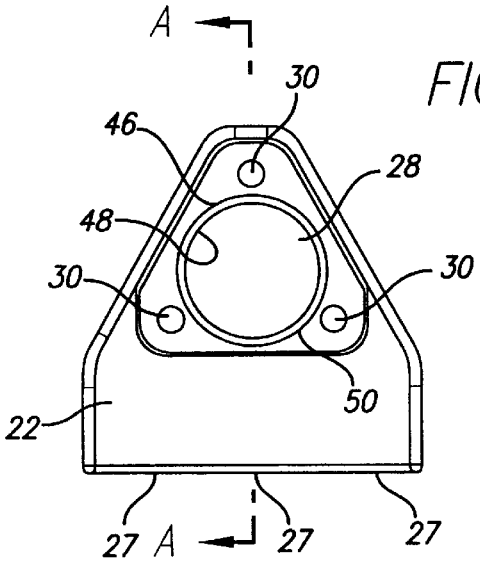
FIG. 2 is a top plan view of the clamp body shown in FIG. 1.
Figure 3:
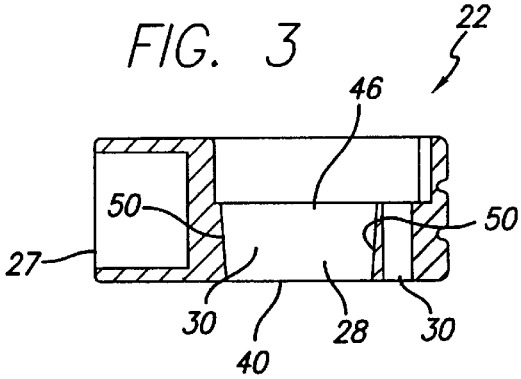
FIG. 3 is a cross-sectional view of the clamp body taken through line A—A of FIG. 2.

Referring to FIGS. 1–3, the preferred embodiment of a battery terminal connector 20 in accordance with my invention includes a clamp body 22, a compression ring 24, and a compression plate 26. The clamp body 22 is made of an electrically conductive material and includes at least one cable socket 27 for receiving an end of a battery cable (not shown), which is connected to the socket using a compression fitting (not shown). As shown in FIG. 1, multiple cable sockets 27 can be provided to accommodate different sized battery cables. A tapered hole 28 extends through the clamp body 22. The tapered hole 28 tapers from a large opening 46 to a small opening 48 and has an interior surface 50. The tapered hole 28 is sized to loosely receive a battery terminal post 10. Threaded screw holes 30 extend through the clamp body 22 generally parallel to the tapered hole 28 for receiving threaded fasteners such as mounting screws 32. For durability and to reduce galling, the clamp body 22 preferably is made of brass or some other suitable metal having a hardness of at least about 60 on the Rockwell B scale.

Referring to FIGS. 4 and 5, the compression ring 24 is generally C-shaped, having a slot 31, and is generally elongated. The compression ring 24 has an inner peripheral wall 34 that is tapered at an angle B substantially similar to the taper angle of the terminal post 10 and an outer peripheral wall 36 that is tapered at an angle C from a large end 38 to a small end 40, with the taper of the inner peripheral wall 34 and the outer peripheral wall 36 being opposed to each other. The compression ring 24 is sized to fit over the battery post 10 and into the tapered hole large opening 46 so that the compression ring 24 seats against the tapered hole inner surface 50 as the ring 24 is pressed into the tapered hole 28. The compression ring 24 is made of an electrically conductive material to permit a good electrical connection with the terminal post 10. Preferably, the compression ring 24 is made of brass or some other suitable metal having a hardness of at least about 60 on the Rockwell B scale so that it resists galling and substantially retains its shape after it is removed as described below.

Referring to FIGS. 6 and 7, the compression plate 26 is adapted to be mounted to the clamp body 22 over the tapered hole 28. A circular flange 42 is disposed on and projects from a surface of the compression plate 26 to contact the compression ring large end 38 when the compression ring 24 is inserted into the tapered hole 28. The flange is sized to make contact with the compression ring large end 38 and to press the compression ring 24 into the tapered hole 28 when the compression plate 26 is mounted to the clamp body 22. The flange 42 is also sized so that it will fit within the tapered hole large opening 46. Mounting holes 44 extend through the compression plate 26 and are sized to receive the mounting screws 32. The mounting holes 44 are located so that they align with the screw holes 30 in the clamp body 22 when the compression plate 26 is mounted to the clamp body 22. Preferably, the compression plate 26 is made of brass, aluminum or some other suitable metal having a hardness of at least about 60 on the Rockwell B scale.

To connect the terminal connector 20 to the battery terminal post 10, the small end 40 of compression ring 24 is pressed lightly into the tapered hole large opening 46 until the compression ring 24 seats against the tapered hole interior surface 50. The clamp body 22, with the compression ring 24 loosely seated into the tapered hole 28, is then slipped onto the battery terminal post 10. The compression plate 26 is placed over tapered hole 28 so that the flange 42 is into contact with the compression ring large end 38 and so that the compression plate mounting holes 44 are aligned with the threaded clamp body screw holes 30. The mounting screws 32 are inserted through the mounting holes 44 and into the screw holes 30 and are tightened, for example with a small screw driver, thereby causing the compression plate 26 and flange 42 to press the compression ring 24 further into the tapered hole 28 and to compress the ring 24 so that the width of the slot 31 is reduced. This achieves a tight electrical contact between the terminal post 10 and compression ring inner wall 34 and between the compression ring outer wall 36 and the tapered hole interior surface 50, thereby achieving electrical contact with the battery cable. During use, the compression plate 26 remains mounted to the clamp body 22 to hold the compression ring 24 in the tapered hole 28, thereby maintaining electrical contact with terminal post 10 despite jarring and vibrations to the connector.

To remove the battery terminal connector 20 from the terminal post 10, the mounting screws 32 are unscrewed and the compression plate 26 is removed from the clamp body 22. To remove the compression ring 24 from the battery post 10, the user simply pulls the clamp body 22 off the battery post 10 or taps the clamp body 22 with a hard object, such as a hammer, which causes the compression ring 24 to release from its seat in the tapered hole 28. The compression ring 24 and the clamp body 22 can then easily be slid off the terminal post 10.

The above-described embodiment and method possess several advantages. By providing the battery terminal connector in the configuration described above, it can be easily and tightly connected to the battery post using a small screwdriver and provides a tight electrical connection with the terminal post that resists loosening by jarring and vibration. In addition, the embodiment and method provide a battery terminal connector that is neat in appearance and is durable. By using components having a hardness of at least about 60 on the Rockwell B scale, the components of the battery terminal connector are durable, resist galling and are reusable. By providing more than one cable socket, the battery terminal connector can accommodate different sized battery cables.

Additional advantages and modifications will readily occur to those skilled in the art. For example, the battery cable can be attached to the clamp body by compression fittings or by ferrules, set screws, soldering or any conventional fastening means known in the art. As another example, the compression plate can be mounted to the clamp body by the mounting screws described above, or by bolts, fasteners or any conventional mounting means known in the art. As a further example, the flange need not be circular in shape so long as it compresses the compression ring into the tapered hole when the compression plate is mounted to the clamp body. Therefore, the invention in its broader aspects is not limited to the specific details, representative devices, and illustrative examples shown and described. Accordingly, departures may be made from such details without departing from the spirit or scope of the general inventive concept as defined by the appended claims and their equivalents.

What is claimed is:

1. A battery terminal connector for connecting a battery cable to a battery terminal post, the battery clamp comprising:

a) a clamp body including:

battery cable connecting means for connecting the battery cable to the clamp body; and a tapered hole for loosely receiving the battery terminal post, the tapered hole having an electrically conductive interior surface electrically coupled to the battery cable connecting means;

b) a generally elongated, electrically conductive compression ring having a tapered inner peripheral wall and a tapered outer peripheral wall, the compression ring being sized to fit into the tapered hole of the clamp body and over the battery terminal post, and the taper of the inner and outer peripheral walls of the ring being opposed to each other;

c) a compression plate adapted to be mounted to the clamp body for pressing the compression ring into the tapered hole when the compression flange is mounted to the clamp body; and d) mounting means for mounting the compression plate to the clamp body.

2. The battery terminal connector of claim 1 wherein the clamp body is made of a material having a hardness of at least about 60 on the Rockwell B scale.

3. The battery terminal connector of claim 1 wherein the compression ring is made of a material having a hardness of at least about 60 on the Rockwell B scale.

4. The battery terminal connector of claim 1 wherein the compression plate is made of a material having a hardness of at least about 60 on the Rockwell B scale.

5. A battery terminal connector for connecting a battery cable to a battery terminal post, the battery clamp comprising:

a) a clamp body including:

battery cable connecting means for connecting the battery cable to the clamp body;

a tapered hole for loosely receiving the battery terminal post and having an electrically conductive interior surface electrically coupled to the battery cable connecting means; and at least one threaded hole generally parallel to the tapered hole for receiving a threaded fastener;

b) a generally elongated, electrically conductive compression ring having a tapered inner peripheral wall and a tapered outer peripheral wall, the compression ring being sized to fit into the tapered hole of the clamp body and over the battery terminal post, the taper of the inner and outer peripheral walls of the ring being opposed to each other; and c) a compression plate for pressing the compression ring into the tapered hole when the compression plate is mounted to the clamp body, the compression plate including at least one mounting hole for receiving the threaded fastener, the at least one mounting hole being aligned with the at least one clamp body threaded hole when the compression plate is mounted to the clamp body.

6. The battery clamp of claim 5 wherein the clamp body is composed of a material having a hardness of at least about 60 on the Rockwell B scale.

7. The battery clamp of claim 5 wherein the compression ring is composed of a material having a hardness of at least about 60 on the Rockwell B scale.

8. The battery clamp of claim 5 wherein the compression plate is composed of a material having a hardness of at least about 60 on the Rockwell B scale.

9. A method for connecting a battery cable to a battery terminal post, the method comprising the steps of:

a) providing a clamp body having:

battery cable connecting means for connecting the battery cable to the clamp body; and a tapered hole for loosely receiving the battery post and having an electrically conductive interior surface electrically coupled to the battery cable connecting means;

b) providing a a generally elongated, electrically conductive compression ring having a tapered inner peripheral wall and a tapered outer peripheral wall, the compression ring being sized to fit into the tapered hole of the clamp body and over the battery terminal post, and the taper of the inner and outer peripheral walls of the ring being opposed to each other;

c) placing the clamp body over the battery terminal post;

d) placing the compression ring over the battery terminal post;

e) providing a compression plate adapted to be mounted to the clamp body for pressing the compression ring into the tapered hole when the compression plate is mounted to the clamp body; and f) mounting the compression plate to the clamp body.

10. The method of claim 9 wherein the step of providing the clamp body further comprises providing a clamp body composed of a material having a hardness of at least about 60 on the Rockwell B scale.

11. The method of claim 9 wherein the step of providing the compression ring further comprises providing a compression ring composed of a material having a hardness of at least about 60 on the Rockwell B scale.

12. The method of claim 9 wherein the step of providing the compression plate further comprises providing a compression plate composed of a material having a hardness of at least about 60 on the Rockwell B scale.

* * * * *